US010517409B1

(12) United States Patent
Shoup et al.

(10) Patent No.: US 10,517,409 B1
(45) Date of Patent: Dec. 31, 2019

(54) BABY ROCKER

(71) Applicants: John Shoup, Woodland, WA (US); Josiah Wilfong, Woodland, WA (US)

(72) Inventors: John Shoup, Woodland, WA (US); Josiah Wilfong, Woodland, WA (US)

( * ) Notice: Subject to any disclaimer, the term of this patent is extended or adjusted under 35 U.S.C. 154(b) by 0 days.

(21) Appl. No.: 16/242,147

(22) Filed: Jan. 8, 2019

(51) Int. Cl.

| | |
|---|---|
| ***A63G 21/16*** | (2006.01) |
| ***A47D 13/10*** | (2006.01) |
| ***A47D 15/00*** | (2006.01) |
| ***A47D 9/02*** | (2006.01) |
| *A47D 13/02* | (2006.01) |

(52) U.S. Cl.
CPC ..... *A47D 13/105* (2013.01); *A47D 9/02* (2013.01); *A47D 15/008* (2013.01)

(58) Field of Classification Search
CPC ..... A47D 5/00; A47D 13/00; A47D 13/02; A47D 13/08; A47G 9/00; A47G 9/083; A63B 21/00; A63B 21/068; A63B 21/4035; A63G 11/00; A63G 13/06
USPC ..... 472/95, 106, 110; 5/655
See application file for complete search history.

(56) References Cited

U.S. PATENT DOCUMENTS

| | | | | |
|---|---|---|---|---|
| 4,754,747 | A | 7/1988 | Hasofer | |
| 5,329,934 | A * | 7/1994 | Bowman | A47D 13/08 128/870 |
| 5,499,949 | A * | 3/1996 | Heubl | A47D 13/105 297/274 |
| 7,107,639 | B2 | 9/2006 | Taricani | |
| 7,350,253 | B2 * | 4/2008 | Simon | A47D 7/002 297/260.1 |
| 7,546,652 | B1 | 6/2009 | Maloof | |
| D619,401 | S | 7/2010 | Deenadayalu | |
| 8,607,386 | B2 | 12/2013 | Daly | |
| 8,938,830 | B2 | 1/2015 | Paperno | |
| 2008/0092300 | A1 * | 4/2008 | Joe | A47D 13/08 5/655 |
| 2009/0178202 | A1 * | 7/2009 | Kovalyak | A47C 20/026 5/655 |
| 2010/0275932 | A1 | 11/2010 | Shackleton | |
| 2015/0038887 | A1 | 2/2015 | Piccirillo | |

FOREIGN PATENT DOCUMENTS

| | | |
|---|---|---|
| EP | 2457471 | 7/2013 |

* cited by examiner

*Primary Examiner* — Kien T Nguyen

(57) ABSTRACT

The baby rocker may be adapted to safely support an infant in a prone position and to rock and gyrate the infant while the infant is in the prone position. A sturdy base may support a platform via a gyrator on the bottom of the platform. The platform may be padded for comfort. The platform may provide two side walls to prevent the infant from rolling off of the platform in addition to a harness, belt, and rest straps top restrain the infant. The platform may provide a pair of leg holes that the infants legs may pass through. Leg hole coverings may be provided to cover the leg holes if a solid platform surface is desired.

12 Claims, 4 Drawing Sheets

BABY ROCKER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of infant care, more specifically, a baby rocker.

Various types of baby rockers are known in the prior art. Placing a baby on its stomach soothes and calms the infant, helps to strengthen and develop the infant's back muscles, and assists with speeding up abdominal peristalsis. This position also facilitates burping of the infant, and helps to relieve gas and discomfort. However, most existing cradles and rockers do not allow a baby to remain comfortably and safely in a downwardly facing position. Of those that do, even fewer maintain the rocking or gyrating capabilities that traditional rockers offer. What is needed, and what the present downwardly facing baby rocker provides, is a baby rocker that can safely and is both rockable and gyratable in order to create soothing motions.

SUMMARY OF INVENTION

The baby rocker may be adapted to safely support an infant in a prone position and to rock and gyrate the infant while the infant is in the prone position. A sturdy base may support a platform via a gyrator on the bottom of the platform. The platform may be padded for comfort. The platform may provide two side walls to prevent the infant from rolling off of the platform in addition to a harness, belt, and rest straps top restrain the infant. The platform may provide a pair of leg holes that the infants legs may pass through. Leg hole coverings may be provided to cover the leg holes if a solid platform surface is desired.

An object of the invention is to provide a rockable, gyratable platform for a prone infant.

Another object of the invention is to provide side walls, a harness, a belt, and a pair of wrist straps that may be used to restrain the infant.

A further object of the invention is to provide leg holes and leg hole coverings.

Yet another object of the invention is to provide a padded upper surface for comfort of the infant.

These together with additional objects, features and advantages of the baby rocker will be readily apparent to those of ordinary skill in the art upon reading the following detailed description of the presently preferred, but nonetheless illustrative, embodiments when taken in conjunction with the accompanying drawings.

In this respect, before explaining the current embodiments of the baby rocker in detail, it is to be understood that the baby rocker is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the baby rocker.

It is therefore important that the claims be regarded as including such equivalent construction insofar as they do not depart from the spirit and scope of the baby rocker. It is also to be understood that the phraseology and terminology employed herein are for purposes of description and should not be regarded as limiting.

BRIEF DESCRIPTION OF DRAWINGS

The accompanying drawings, which are included to provide a constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not there is no intention to be bound by any expressed or implied theory presented in the preceding technical field, background, brief summary or the following detailed description. As used herein, the word "or" is intended to be inclusive.

Figure 1:
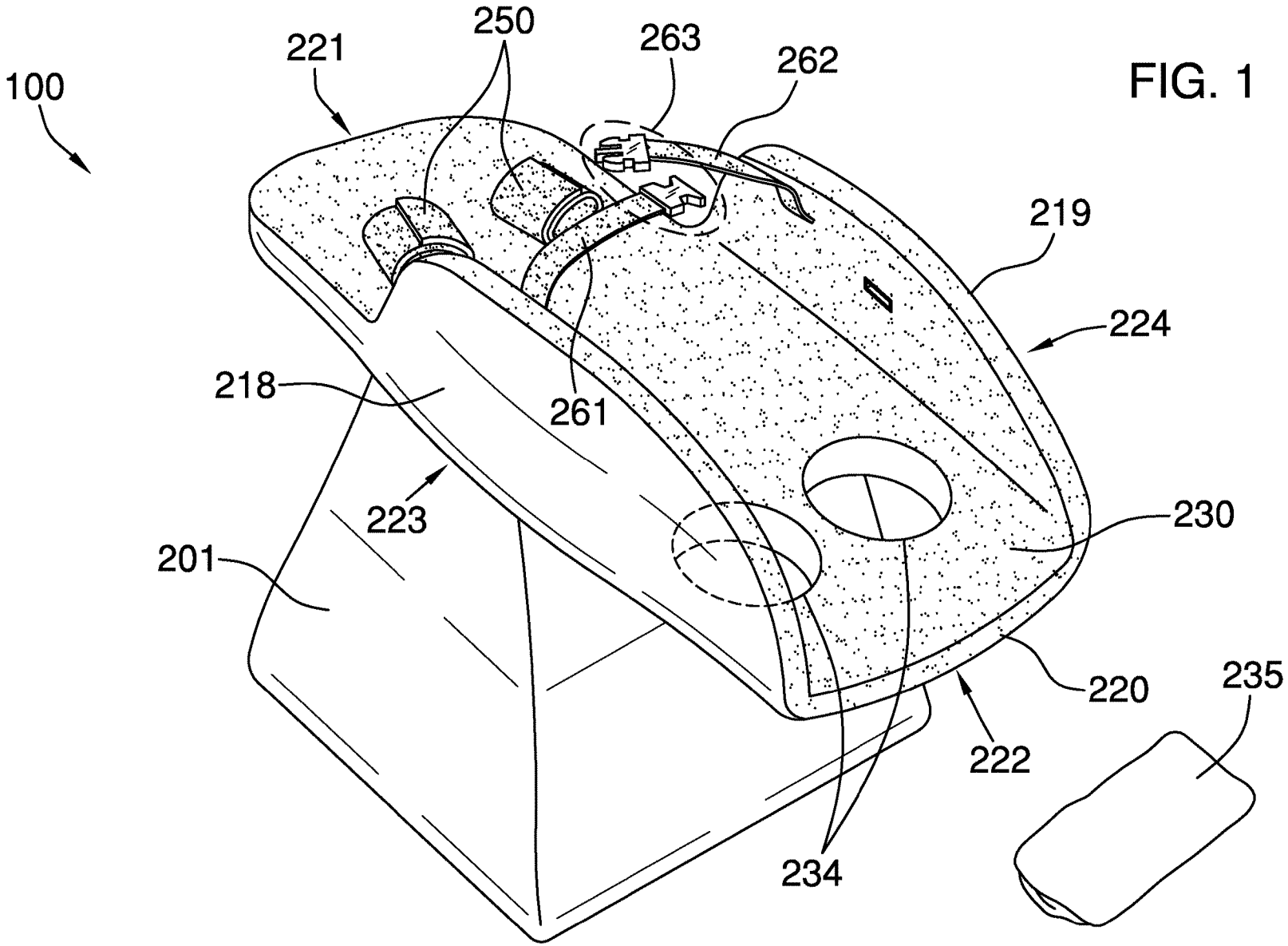
FIG. 1 is a perspective view of an embodiment of the disclosure.
Figure 2:
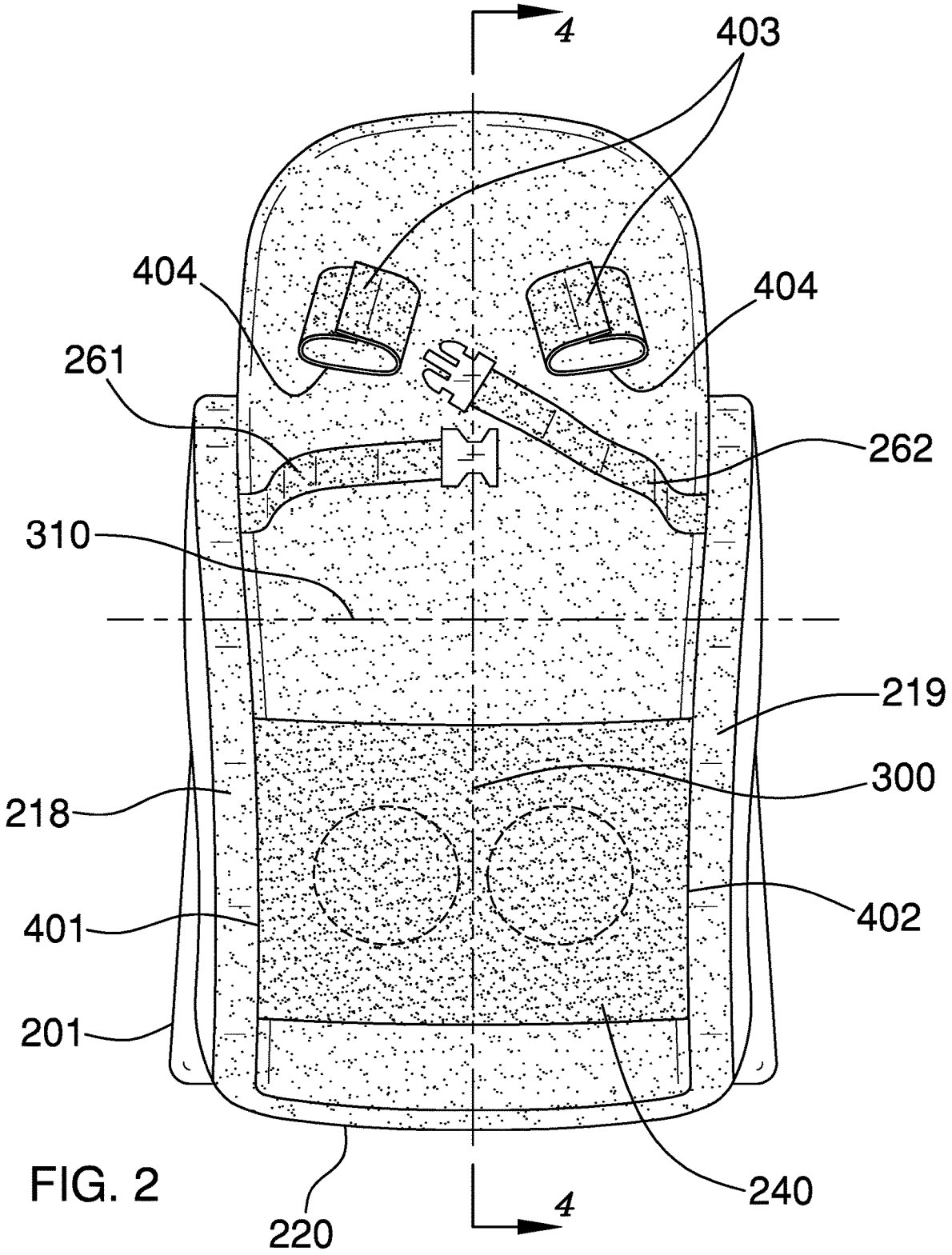
FIG. 2 is a top view of an embodiment of the disclosure.
Figure 3:
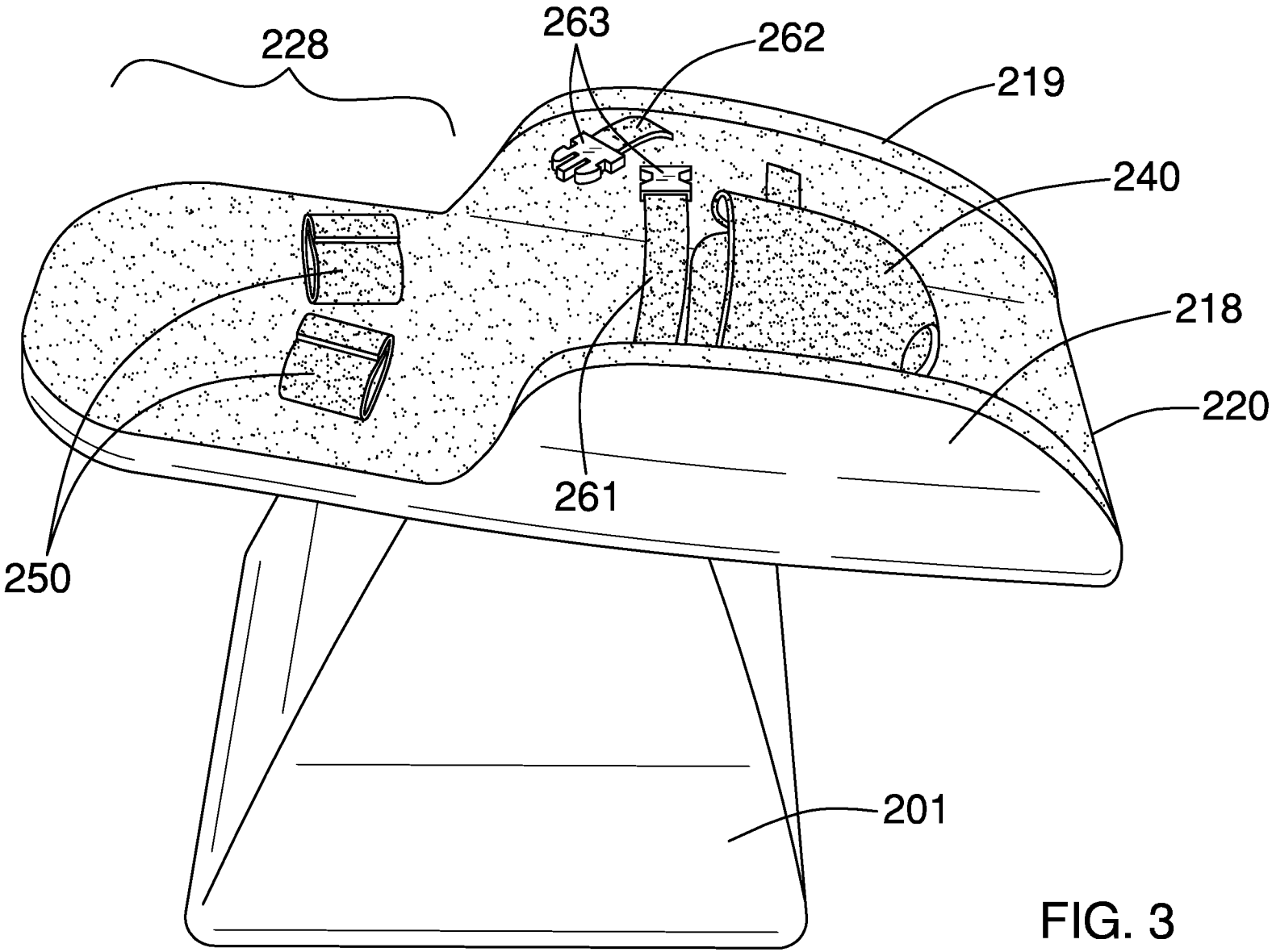
FIG. 3 is a side view of an embodiment of the disclosure.
Figure 4:
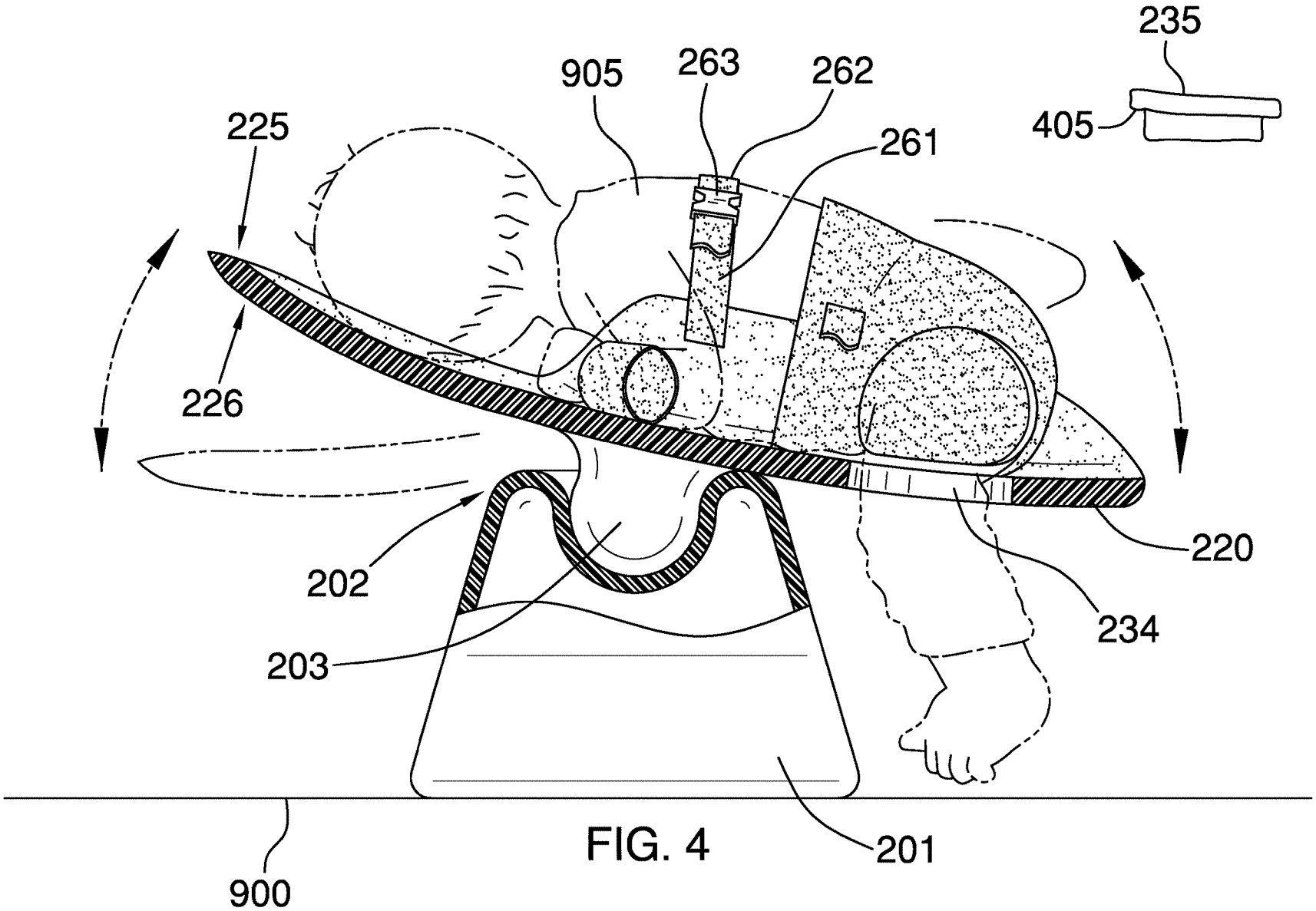
FIG. 4 is a cross-sectional view of an embodiment of the disclosure across 4-4 as shown in FIG. 2.

Detailed reference will now be made to a first potential embodiment of the disclosure, which is illustrated in FIGS. 1 through 4.

The baby rocker 100 (hereinafter invention) comprises a sturdy base 201, a platform 220, and a lockable, gyratable mechanism 203. The invention 100 may be adapted to safely support an infant 905 in a prone position and to rock and gyrate the infant 905 while the infant 905 is in the prone position.

The sturdy base 201 may be a support structure for the invention 100. The overall shape of the sturdy base 201 may be pyramidal or conical, rising from a bottom that is wider than the top for stability. The bottom of the sturdy base 201 may rest upon a horizontal surface 900. The sturdy base 201 may comprise an open top side 202 into which the lockable, gyratable mechanism 203 rests.

The platform 220 may be a support surface that is adapted to support the infant 905. The platform 220 may be defined by a front end 221, a back end 222, a left side 223, a right side 224, an upper surface 225, a bottom surface 226, a longitudinal comprise a left side wall 218 and a right side wall 219. The left side wall 218 and the right side wall 219 may protect the infant 905 from rolling off of the platform 220 and may serve as a mounting point for a belt, a harness 240 or both. The left side wall 218 may arch upwards from the left edge of the platform 220. The right side wall 219 may arch upwards from the right edge of the platform 220. The platform 220, including the left side wall 218 and the right side wall 219, may be symmetrical across the longitudinal axis 300. In some embodiments, a section of the platform 228 closest to the front end 221 of the platform 220 may not curve upwards on the sides.

The platform 220 may be adapted to rock and gyrate when an adult moves the platform 220 relative to the sturdy base 201 using their hands. Throughout this document, the adult refers to the person responsible for the well-being of the infant 905 regardless of whether that person is a parent, nanny, nurse, older sibling, or another individual. The platform 220 may be rockable along the longitudinal axis 300, along the latitudinal axis 310, or combinations thereof. The platform 220 may be gyratable in both clockwise and counterclockwise directions.

The lockable, gyratable mechanism 203 may be disposed within the sturdy base 201 and may extend into the open top side 203 may be free to pivot and turn while resting within the open top side 202 of the sturdy base 201.

The platform 220 may have pair of leg holes 234 extending from the upper surface 225 to the bottom surface 226. The pair of leg holes 234 may be disposed proximal the back end 222 of the platform 220. The pair of leg holes 234 may be disposed symmetrically across the longitudinal axis 300.

The upper surface 225 may comprise a padding 230. The padding 230 may cover the entire surface of the upper surface 225. The padding 230 may be removable and washable.

The infant 905 may be restrained by the harness 240. The harness 240 may be composed of a flexible material. As non-limiting examples, the harness 240 may be composed of cloth or canvas. The harness 240 may couple to the left side wall 218 and the right side wall 219 via a first attachment mechanism 401 and a second attachment mechanism 402. The harness 240 may be fully or partially removable. As a non-limiting example, the first attachment mechanism 401 may be a permanent coupling of the harness 240 to the left side wall 218 and the second attachment mechanism 402 may be a releasable coupling between the harness 240 and the right side wall 219. As a further non-limiting example, the first attachment mechanism 401 and the second attachment mechanism 402 may both be releasable couplings side wall 219. As non-limiting examples, the first attachment mechanism 401, the second attachment mechanism 402, or both may be snaps or hook and loop fasteners.

The belt may further restrain the infant 905 to prevent the infant 905 from falling off of the platform 220. The belt may comprise a left belt 261, a right belt 262, and a buckle 263. One end of the left belt 261 may be coupled to the left side wall 218 and one end of the right belt 262 may be coupled to the right side wall 219. The free ends of the left belt 261 and the right belt 262 may be coupled to halves of the buckle 263 such that the left belt 261 and the right belt 262 may be joined by fastening the buckle 263.

The invention 100 may comprise a pair of wrist straps 250. The pair of wrist straps 250 may be flexible bands. An individual wrist strap selected from the pair of wrist straps 250 may be adapted to wrap around a wrist of the infant 905 to limit motion of the upper body. The overlapping ends of the individual wrist strap may releasably couple at a third attachment mechanism 403. As non-limiting examples, the third attachment mechanism 403 may be snaps or hook and loop fasteners.

The pair of wrist straps 250 may be removable from the platform 220. The individual wrist strap selected from the pair via a fourth attachment mechanism 404. As non-limiting examples, the fourth attachment mechanism 404 may be snaps or hook and loop fasteners.

The invention 100 may comprise one or more leg hole coverings 235. The one or more leg hole coverings 235 may be removable. The one or more leg hole coverings 235 may make the pair of leg holes 234 inaccessible when the one or more leg hole coverings 235 are installed. The one or more leg hole coverings 235 may comprise individual covers for each of the pair of leg holes 234 or a single piece configured to cover both of the pair of leg holes 234. The one or more leg hole coverings 235 may have a fifth attachment mechanism 405, with the fifth attachment mechanism 405 being snaps or hook-and-loop fasteners.

In use, the sturdy base 201 may be placed upon the horizontal surface 900 and the platform 220 may be placed on top of the sturdy base 201 such that the lockable, gyratable mechanism 203 rests within the open top side 202 of the sturdy base 201. The infant 905 may be placed in a prone position on the top of the platform 220. The infant 905 may be restrained by the harness 240, the belt, the pair of wrist straps 250, or combinations thereof. The adult may rock the platform 220 around the longitudinal axis 300, the latitudinal axis 310, or around a vertical axis in both clockwise and counterclockwise directions.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, the word "buckle" refers to any fastener that is used for joining a first loose end of a strap to a second loose end of the same strap or to a loose end of a different strap.

As used herein, the words "couple", "couples", "coupled" or "coupling", refer to connecting, either directly or indirectly, and does not necessarily imply a mechanical connection.

As used in this disclosure, the terms "distal" and "proximal" may be used to describe relative positions. Distal refers to the object, or the end of an object, that is situated away from the point of origin, point of reference, or point of attachment. Proximal refers to the object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point or a central axis of an object and the direction of comparison may be in a radial or lateral direction.

As used in this disclosure, "flexible" refers to an object or material which will deform when a force is applied to it, which will not return to its original shape when the deforming force is removed, and which may not retain the deformed shape caused by the deforming force.

As used herein, "front" indicates the side of an object that is closest to a forward direction of travel under normal use of the object or the side or part of an object that normally presents itself to view or that is normally used first. "Rear" or "back" refers to the side that is opposite the front.

As used herein, "gyrate" or "gyration" refers to a repetitive motion back and forth around a vertical axis of rotation.

As used in this disclosure, a "harness" is an apparatus comprising a plurality of straps and one or more fasteners that is used to fasten or anchor a first person or first object to a second object. The phrase "N point harness" refers to the installation of the harness wherein the harness has N anchor points. As a non-limiting example, a 2 point harness has two anchor points while a 5 point harness has 5 anchor points.

As used in this disclosure, a "hook and loop fastener" is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface.

As used in this disclosure, "horizontal" is a directional term that refers to a direction that is perpendicular to the local force of gravity. Unless specifically noted in this disclosure, the horizontal direction is always perpendicular to the vertical direction.

As used herein, the word "longitudinal" or "longitudinally" refers to a lengthwise or longest direction.

As used herein, the word "pivot" is intended to include any mechanical arrangement that allows for rotational motion. Non-limiting examples of pivots may include hinges, holes, posts, dowels, pins, points, rods, shafts, balls, and sockets, either individually or in combination.

As used herein, "prone" refers to a horizontal position where the dorsal side is up and the ventral side is down and "supine" refers to a horizontal position where the dorsal side is down and the ventral side is up. As non-limiting examples, a person lying on their stomach is in a prone position and a person lying on their back is in a supine position.

As used in this disclosure a "strap" is a strip of leather, cloth, nylon, plastic, thin metal, rubber, or other flexible material, that is used to fasten, secure, carry, or hold onto something. A strap is sometimes used in conjunction with a buckle.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A baby rocker comprising:

a sturdy base, a platform, and a lockable, gyratable mechanism;

wherein the baby rocker is adapted to safely support an infant in a prone position and to rock the infant while the infant is in the prone position;

wherein the sturdy base is a support structure for the baby rocker;

wherein the overall shape of the sturdy base is pyramidal or conical, rising from a bottom that is wider than the top for stability;

wherein the bottom of the sturdy base rests upon a horizontal surface;

wherein the sturdy base comprises an open top side into which the lockable, gyratable mechanism rests;

wherein the platform is a support surface that is adapted to support the infant;

wherein the platform is defined by a front end, a back end, a left side, a right side, an upper surface, a bottom surface, a longitudinal axis, and a latitudinal axis;

wherein the platform comprises a left side wall and a right side wall;

wherein the left side wall and the right side wall protect the infant from rolling off of the platform and serve as a mounting point for a belt, a harness or both;

wherein the left side wall arches upwards from the left edge of the platform;

wherein the right side wall arches upwards from the right edge of the platform;

wherein the platform, including the left side wall and the right side wall, is symmetrical across the longitudinal axis;

wherein the platform is adapted to rock and gyrate when an adult moves the platform relative to the sturdy base using their hands;

wherein the platform is rockable along the longitudinal axis, along the latitudinal axis, or combinations thereof;

wherein the platform is gyratable in both clockwise and counterclockwise directions;

wherein the lockable, gyratable mechanism is disposed within the sturdy base and extends into the open top side of the sturdy base;

wherein the lockable, gyratable mechanism is free to pivot and turn while resting within the open top side of the sturdy base.

2. The baby rocker according to claim 1 wherein a section of the platform closest to the front end of the platform does not curve upwards on the sides.

3. The baby rocker according to claim 1 wherein the platform has pair of leg holes extending from the upper surface to the bottom surface;

wherein the pair of leg holes are disposed proximal the back end of the platform;

wherein the pair of leg holes are disposed symmetrically across the longitudinal axis.

4. The baby rocker according to claim 3 wherein the upper surface comprises a padding;

wherein the padding covers the entire surface of the upper surface.

5. The baby rocker according to claim 4 wherein the padding is removable and washable.

6. The baby rocker according to claim 4 wherein the harness is adapted to restrain the infant;

wherein the harness is composed of a flexible material;

wherein the harness couples to the left side wall and the right side wall via a first attachment mechanism and a second attachment mechanism;

wherein the harness is fully or partially removable.

7. The baby rocker according to claim 6 wherein the first attachment mechanism is a permanent coupling of the harness to the left side wall and the second attachment mechanism is a releasable coupling between the harness and the right side wall.

8. The baby rocker according to claim 6 wherein the first attachment mechanism and the second attachment mechanism are both releasable couplings between the harness and the left side wall and the right side wall.

9. The baby rocker according to claim 6 wherein the belt is adapted to further restrain the infant;

wherein the belt comprises a left belt, a right belt, and a buckle;

wherein one end of the left belt is coupled to the left side wall and one end of the right belt is coupled to the right side wall;

wherein the free ends of the left belt and the right belt are coupled to halves of the buckle such that the left belt and the right belt are joined by fastening the buckle.

10. The baby rocker according to claim 9 wherein the baby rocker comprises a pair of wrist straps;

wherein the pair of wrist straps are flexible bands;

wherein an individual wrist strap selected from the pair of wrist straps is adapted to wrap around a wrist of the infant to limit motion of the upper body;

wherein the overlapping ends of the individual wrist strap releasably couple at a third attachment mechanism.

11. The baby rocker according to claim 10 wherein the pair of wrist straps is removable from the platform;

wherein the individual wrist strap selected from the pair of wrist straps releasably couples to the platform via a fourth attachment mechanism.

12. The baby rocker according to claim 10 wherein the baby rocker comprises one or more leg hole coverings;

wherein the one or more leg hole coverings are removable;

wherein the one or more leg hole coverings make the pair of leg holes inaccessible when the one or more leg hole coverings are installed;

wherein the one or more leg hole coverings comprise individual covers for each of the pair of leg holes or a single piece configured to cover both of the pair of leg holes.

* * * * *